US006665895B1

(12) United States Patent
St. Pierre et al.

(10) Patent No.: US 6,665,895 B1
(45) Date of Patent: Dec. 23, 2003

(54) PLAYYARD FLOOR LOCK SYSTEM

(75) Inventors: William St. Pierre, Forestdale, MA (US); Michael C. Dorsey, Brownsburg, IN (US); Richard Glover, Greenwood, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/327,434

(22) Filed: Dec. 20, 2002

(51) Int. Cl.[7] ..... A47D 13/06
(52) U.S. Cl. ..... 5/99.1; 5/98.1; 403/102
(58) Field of Search ..... 5/98.1, 99.1; 403/102

(56) References Cited

U.S. PATENT DOCUMENTS

| | | | | |
|---|---|---|---|---|
| 4,688,280 A | | 8/1987 | Kohus et al. | |
| 4,739,527 A | | 4/1988 | Kohus et al. | |
| 4,811,437 A | | 3/1989 | Dillner et al. | |
| 5,239,714 A | | 8/1993 | Huang | |
| 5,279,006 A | | 1/1994 | Teng | |
| 5,339,470 A | | 8/1994 | Shamie | |
| 5,353,451 A | | 10/1994 | Hsiung | |
| 5,358,220 A | | 10/1994 | Yu-Kuang | |
| 5,465,439 A | | 11/1995 | Chien | |
| 5,504,951 A | | 4/1996 | Yeh | |
| 5,697,111 A | | 12/1997 | Dillner et al. | |
| 5,699,997 A | | 12/1997 | Huang | |
| 5,819,342 A | * | 10/1998 | Williams | 5/99.1 |
| 5,937,457 A | | 8/1999 | Wang | |
| 6,123,091 A | | 9/2000 | Flynn et al. | |
| 6,256,814 B1 | * | 7/2001 | Drobinski | 5/99.1 |
| 6,421,850 B1 | | 7/2002 | Welsh, Jr. | |
| 6,467,107 B1 | | 10/2002 | Glover et al. | |
| 6,473,919 B1 | * | 11/2002 | Wang | 5/99.1 |
| 6,510,569 B1 | * | 1/2003 | Hu | 5/99.1 |
| 6,568,004 B1 | * | 5/2003 | Sun | 5/99.1 |
| 2003/0061657 A1 | * | 4/2003 | Longenecker et al. | 5/99.1 |

* cited by examiner

*Primary Examiner*—Michael F. Trettel
(74) *Attorney, Agent, or Firm*—Barnes & Thornburg

(57) ABSTRACT

A playyard floor support frame includes a lock hub arranged to lie under a playyard floor, first and second floor support rails arranged to be mounted for movement in rail-receiving channels formed in the lock hub, and a base for receiving and elevating the lock hub above ground underlying the base. The frame further includes a lock controller mounted on the lock hub and configured to move the first and second floor support rails (at the option of a user) toward one another to establish a "locked" position of the frame and away from one another to establish an "unlocked" position of the frame.

24 Claims, 7 Drawing Sheets

PLAYYARD FLOOR LOCK SYSTEM

BACKGROUND AND SUMMARY

The present disclosure relates to a juvenile playyard, and particularly, to a collapsible frame for a juvenile playyard. More particularly, the present disclosure relates to a collapsible playyard frame including support rails and feet for elevating and supporting a floor mat in a juvenile playyard.

According to the present disclosure, a playyard floor support frame includes a rail mount and at least two floor support rails. Each floor support rail is arranged to be moved relative to the rail mount about a pivot axis between an erected configuration adapted to support a floor mat on the floor support rails and above the rail mount and a collapsed configuration adapted to facilitate storage of the floor support frame.

A first floor support rail includes a first rail pivot post and a first rail lock while a second floor support rail includes a second rail pivot post and a second rail lock. A lock controller is provided to move the first and second floor support rails toward one another to move the first and second rail locks into lock retainer notches formed in the rail mount so that "collapse" of the floor support rails is blocked. The lock controller can also be operated to move the first and second floor support rails away from one another to move the first and second rail locks out of the lock retainer notches formed in the rail mount so that the first and second floor support rails can pivot, respectively, about the first and second rail pivot posts to allow controlled collapse of the floor support rails in preparation for playyard storage.

Additional features of the disclosure will become apparent to those skilled in the art upon consideration of the following detailed description of an illustrative embodiment exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
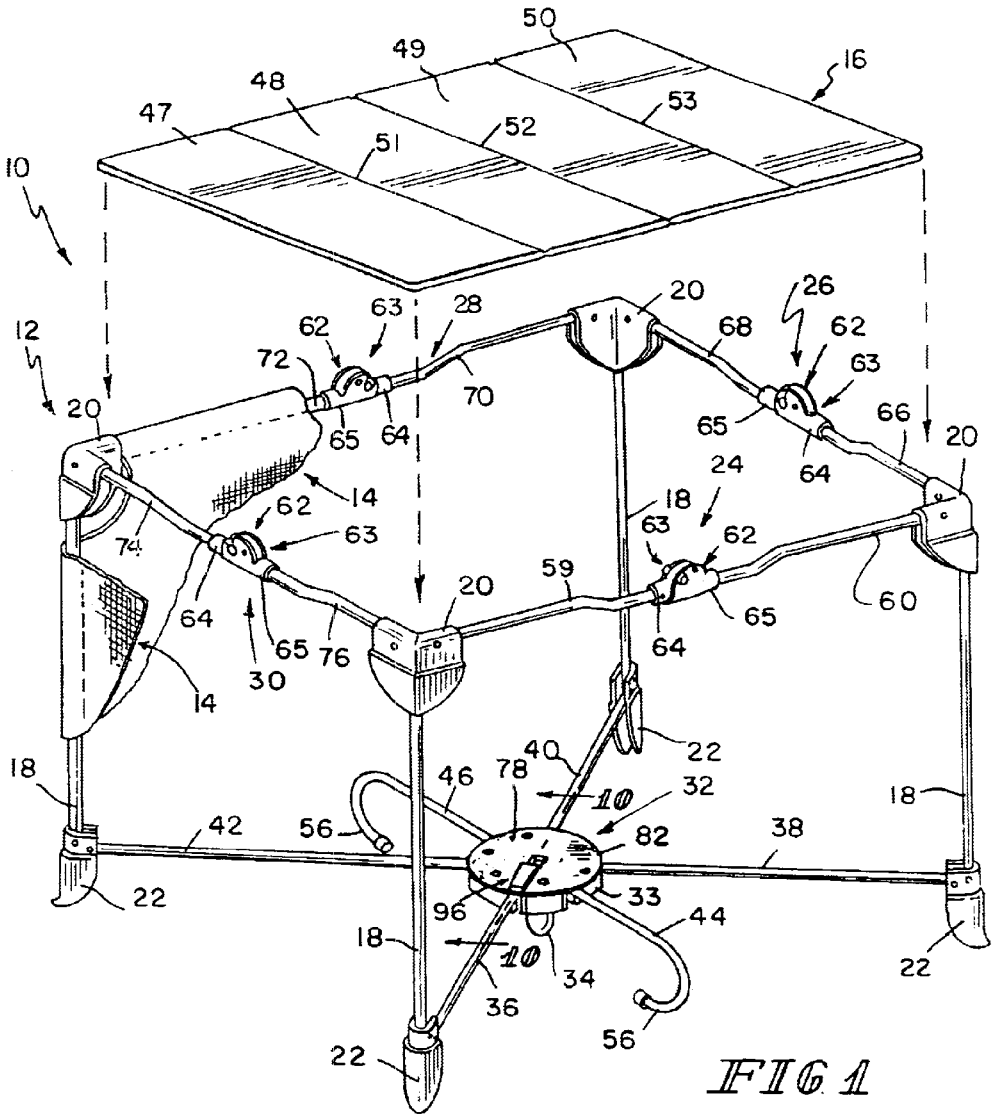
FIG. 1 is a perspective view of a collapsible playyard including a frame in accordance with the present disclosure, a fabric frame cover, and a floor mat for installation in the frame.

Playyard 10 includes a collapsible frame 12, fabric frame cover 14, and removable floor mat 16. Frame cover 14 is made of sturdy fabric and netting material and is foldable to enable frame 12 to be moved easily from an erected configuration shown in FIGS. 1–4 to a collapsed configuration shown in FIGS. 6–8. Floor mat 16 is removed from frame 12 (as shown in FIG. 1) prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Frame 12 further includes a rail mount 32 and a floor support rail 36, 38, 40, or 42 interconnecting rail mount 32 and each of the corner feet 22. Rail mount 32 includes a hub receiver 33 and a foot 34 for elevating hub receiver 33 above the ground 54 underlying rail mount 32. Frame 12 also includes two auxiliary support rails 44, 46 coupled to rail mount 32.

Floor mat 16 includes four sections 47, 48, 49, and 50 arranged in series as shown in FIG. 1. Section 47 is coupled to section 8 at fold line 51, section 48 is coupled to section 49 at fold line 52, and section 49 is coupled to section 50 at fold line 53. Floor mat 16 can be "unrolled" to assume the flat configuration shown in FIG. 1 and then dropped in place to provide a sturdy playyard floor supported in an elevated position above the ground 54 underlying playyard 10 by rail mount 32 and support rails 36, 38, 40, 42, 44, and 46.

Figure 6:
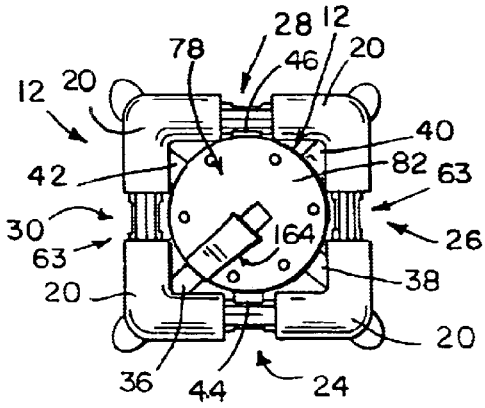
FIG. 6 is a top plan view of the playyard of FIG. 2 after the floor mat has been removed and the playyard frame has been fully collapsed.
Figure 8:
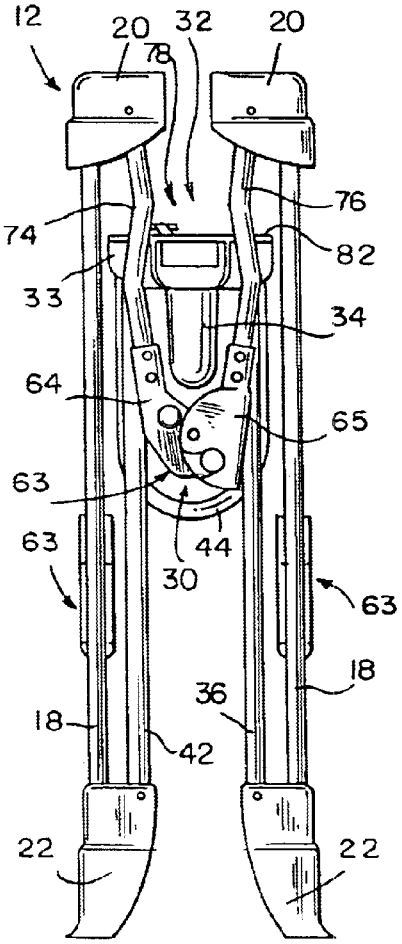
FIG. 8 is an end elevation view of the fully collapsed playyard frame of FIG. 6.
Figure 7:
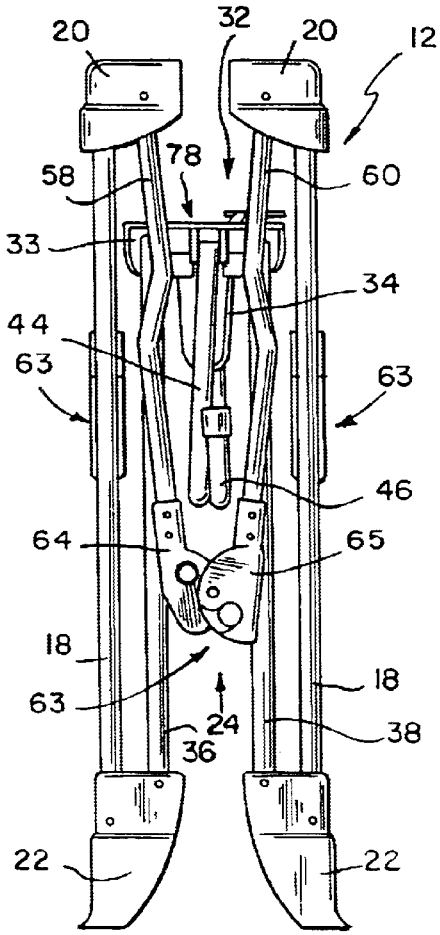
FIG. 7 is a side elevation view of the fully collapsed playyard frame of FIG. 6.

Each of support rails 36, 38, 40, and 42 has an outer end pivotably coupled to one of the corner feet 22 and an inner end arranged for pivotable movement relative to rail mount 32 so as to facilitate collapsing movement of frame 12 from its erected configuration shown in FIGS. 1–4 to its collapsed configuration shown in FIGS. 6–8. Each of auxiliary support rails 44 and 46 has an inner end pivotably coupled to rail mount 32 and an outer end formed to define a rail support foot 56 as shown, for example, in FIGS. 1 and 4. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Figure 2:
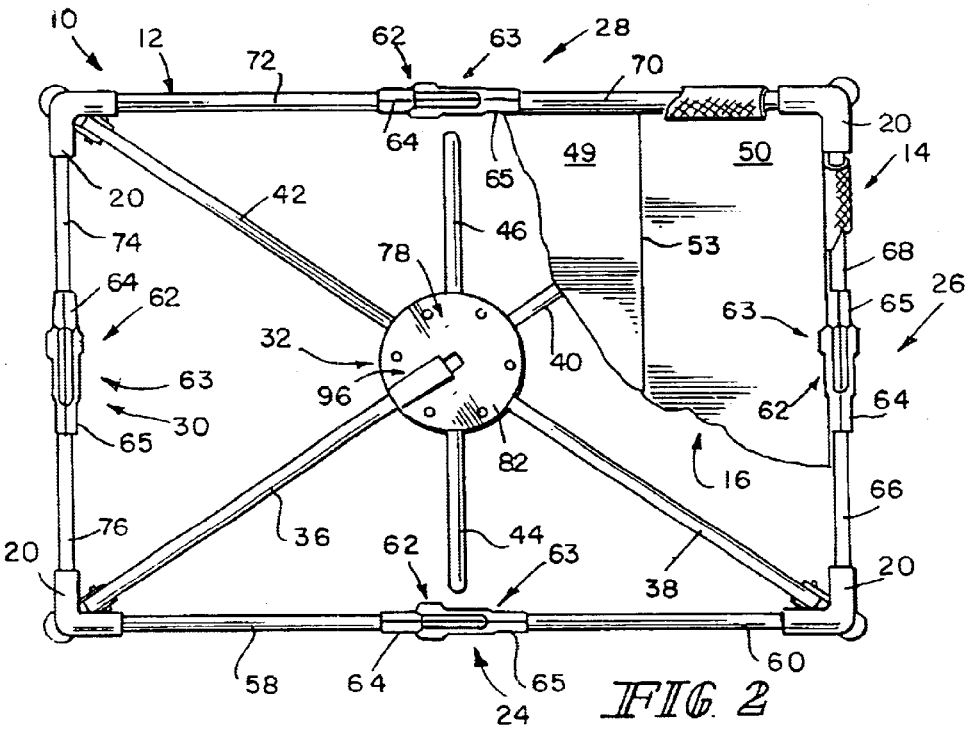
FIG. 2 is a top plan view of the playyard of FIG. 1, with portions broken away, showing an arrangement of six support rails pivotably coupled to a rail mount and positioned to underlie and support the floor mat now installed in the frame and showing four top rails arranged in a rectangular pattern above and around the support rails, each top rail including left and right rail segments and a releasable segment lock.
Figure 3:
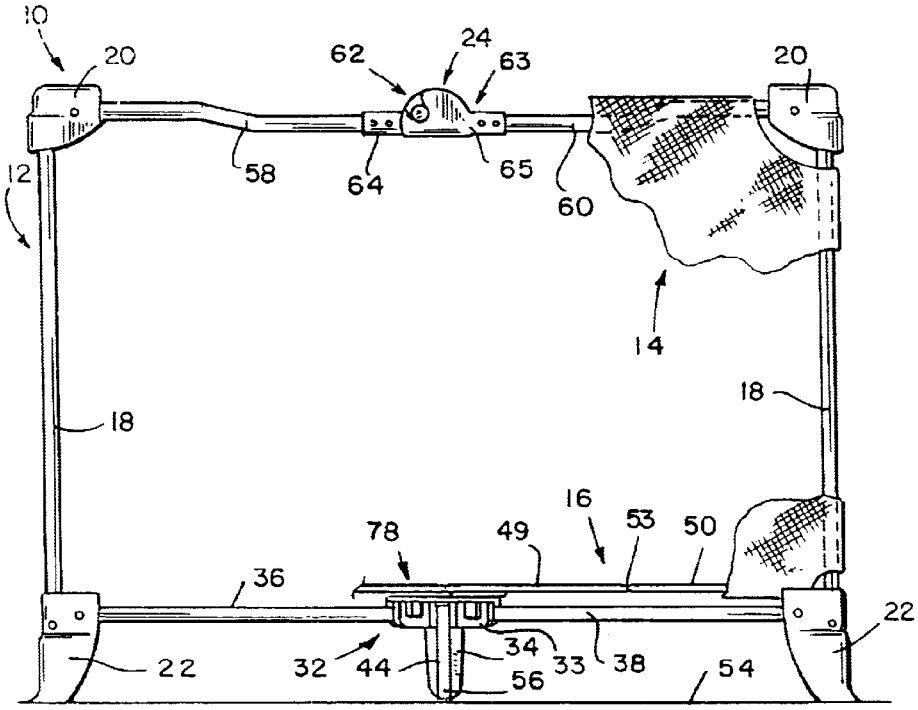
FIG. 3 is a side elevation view of the playyard of FIG. 2 showing a foot appended to the underside of a hub receiver included in the rail mount to support the hub receiver in an elevated position above the ground underlying the floor mat.
Figure 4:
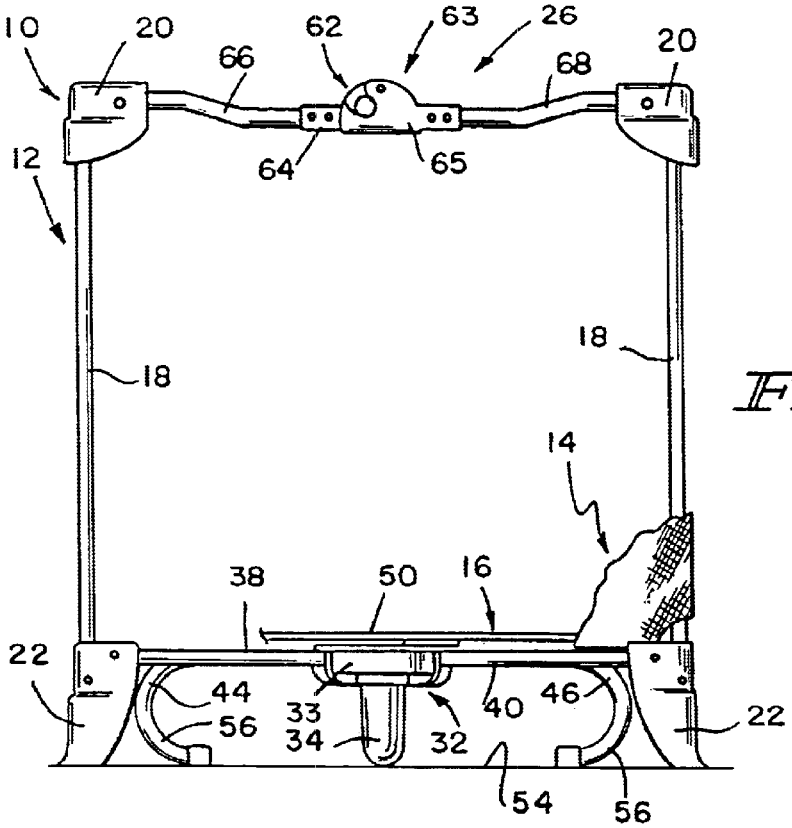
FIG. 4 is an end elevation view of the playyard of FIGS. 2 and 3.

Front top rail 24 includes a left rail segment 58 pivotably coupled to one of the corner pieces 20, a right rail segment 60 coupled for pivotable movement relative to left rail segment 58 (in, for example, the manner described below) and to an adjacent corner piece 20, and a releasable segment lock 62 configured and mounted to "lock" the left and right rail segments 58, 60 together in an in-line relation one to another as shown, for example, in FIGS. 1–3 upon movement of frame 12 to its erected configuration.

Releasable segment lock 62 is mounted in a two-piece lock housing 63 having a left portion 64 rigidly coupled to left rail segment 58 and a right portion 65 rigidly coupled to right rail segment 60 and pivotably coupled to left portion 64. It is within the scope of this disclosure to form left rail segment 58 and left portion 64 as a single piece and to form right rail segment and right portion 65 as a single piece.

Each of right-side top rail 26, rear top rail 28, and left-side top rail is similar in structure to front top rail 24 in that each includes a two-piece lock housing 63 containing a releasable segment lock 62. Right-side top rail 26 includes a left rail segment 66 pivotably coupled tone of the corner pieces 20 and rigidly coupled to a left portion 64 of a second lock housing 63 and a right rail segment 68 pivotably coupled to an adjacent corner piece 20 and rigidly coupled to a right portion 65 of the second lock housing 63. Rear top rail 28 includes a left rail segment 70 pivotably coupled to one of the corner pieces 20 and rigidly coupled to a left portion 64 of a third lock housing 63 and a right rail segment 72 pivotably coupled to an adjacent corner piece 20 and rigidly coupled to a right portion 65 of the third lock housing 63. Left-side top rail 30 includes a left rail segment 74 pivotably coupled to one of the corner pieces 20 and rigidly coupled to a left portion 64 of a fourth lock housing 63 and a right rail segment 76 pivotably coupled to an adjacent corner piece 20 and rigidly coupled to a right portion 65 of the fourth lock housing 63.

A releasable rail lock apparatus 78 is provided in rail mount 32 and configured to lock rail locks included in certain of the support rails 36, 38, 40, 42 to rail mount 32 when frame 12 is in its erected configuration as shown in FIG. 1. In the illustrated embodiment, rail lock apparatus 78 is configured to engage rail locks included in each of support rails 36, 40 to lock support rails 36, 40 to rail mount 32 when frame 12 is in its erected configuration as shown in FIG. 1 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIGS. 5 and 12 during controlled collapse of frame 12.

Figure 5:
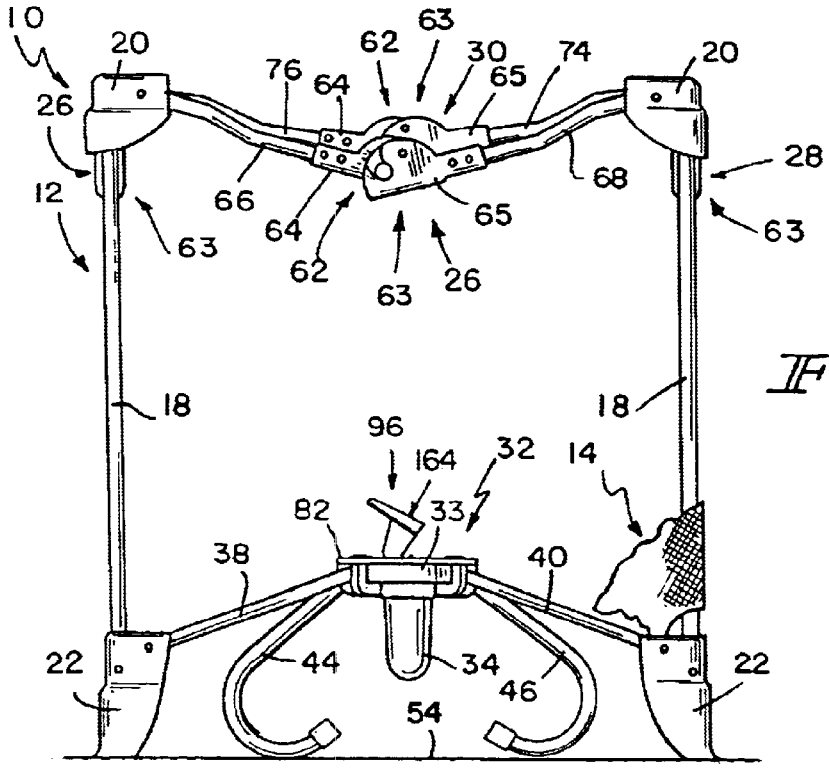
FIG. 5 is a view similar to FIG. 4 of the playyard as it is being collapsed and following unlocking of the rail mount from certain of the pivotable support rails and upward movement of the rail mount away from the ground underlying the playyard (and pivoting movement of the support rails relative to the rail mount) and then release of the segment locks in each of four top rails to allow relative movement of left and right rail segments in each of the four top rails toward collapsed positions.

Referring now to FIGS. 1 and 5, playyard 10 can be collapsed by removing floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 62 to collapse top rails 24, 26, 28, 30 partially. Then frame 12 can be collapsed further to assume a fully collapsed configuration shown, for example, in FIGS. 6–8. Finally, if desired, floor mat 16 can be wrapped around collapsed frame 12 and secured using suitable means to provide a storage case or carrying case for collapsed frame 12.

Figure 9:
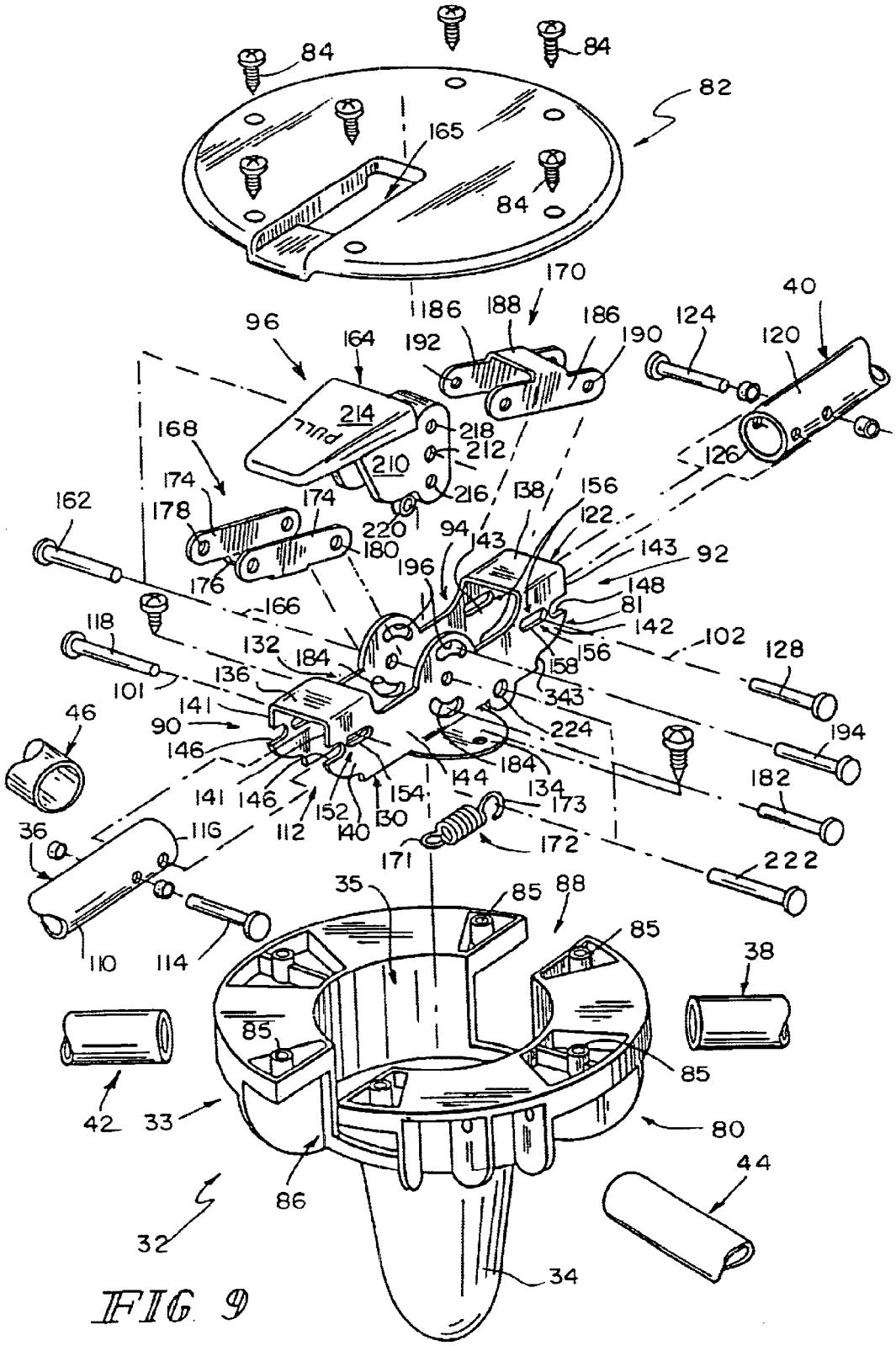
FIG. 9 is an exploded perspective view of components included in a playyard floor support frame in accordance with the present disclosure and showing a lock hub, portions of first and second floor support rails arranged to be mounted for movement in rail-receiving channels formed in the lock hub, and a base for receiving and elevating the lock hub above ground underlying the base, and also showing a lever, a pair of rail movers, and a spring which cooperate to form a lock controller for moving the first and second floor support rails relative to the lock hub between a locked position shown in FIG. 10 and an unlocked position shown in FIG. 11.

One embodiment of rail mount 32, floor support rails 36, 40, and releasable rail lock apparatus 78 is illustrated in FIGS. 9–12. As shown in FIG. 9, rail mount 32 includes a base 80 having a hub receiver 33 and a foot 34. Rail mount 32 also includes a lock hub 81 sized to fit in a chamber 35 formed in hub receiver 33, a cover plate 82 and six plate fasteners 84 for mating with fastener means 85 in hub receiver 33 to retain cover plate 82 in a fixed position on hub receiver 33 to cover the lock hub 81 mounted in chamber 35 of hub receiver 33 as suggested in FIGS. 9–11. Hub receiver 33 is formed to include a first port 86 for receiving a portion of lock hub 81 and first floor support rail 36 therein as suggested in FIGS. 9 and 10 and to include a second port 88 (opposite to first port 86) for receiving a portion of lock hub 81 and second floor support rail 40 therein as suggested in FIGS. 9 and 10.

Lock hub 81 includes a first lock retainer 90 associated with first floor support rail 36, a second lock retainer 92 associated with second floor support rail 40, and a lock controller mount 94 located between first and second lock retainers 90, 92 as shown, for example, in FIGS. 9–12. A lock controller 96 is mounted for movement on lock controller mount 94. Lock controller 96 is coupled to first and second floor support rails 36, 40 so that it can be operated manually to cause first and second floor support rails 36, 40 to move toward one another to mate with first and second lock retainers 90, 92 to lock support rails 36, 40 to lock hub 81 as suggested in FIG. 10 and to cause first and second floor support rails 36, 40 to move away from one another to separate from first and second lock retainers 90, 92 to unlock support rails 36, 40 from lock hub 81 as suggested in FIG. 11. In this unlocked condition, first floor support rail 36 can be pivoted relative to lock hub 81 about a first pivot axis 101 and second floor support rail 40 can be pivoted relative to lock hub 81 about a second pivot axis 102 to allow all floor support rails 36, 38, 40, 42 to move (in the manner suggested in FIG. 12) from the erected configuration shown in FIGS. 1–4 and 10 to the collapsed configuration shown in FIGS. 6–8 and 12.

Figure 10:
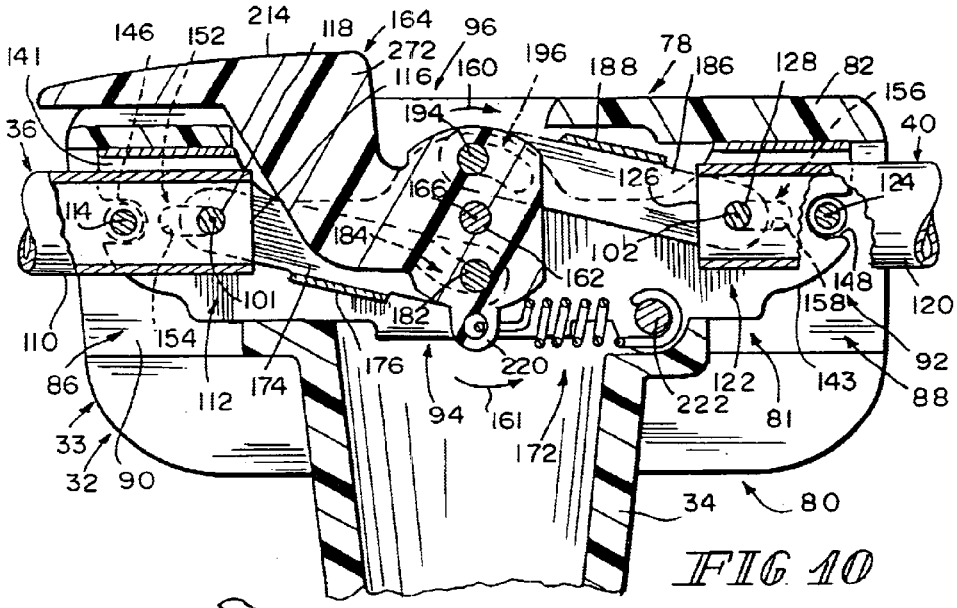
FIG. 10 is a sectional view taken along line 10—10 of FIG. 1 showing retention of a first rail lock on a first floor support rail in a first lock retainer notch formed on a left side of the lock hub to lock the first floor support rail to the lock hub and also showing retention of a second rail lock on a second floor support rail in a second lock retainer notch formed on a right side of the lock hub.

First floor support rail 36 includes a first rail member 110 extending into a first rail-receiving channel 112 formed in lock hub 81 and a first rail lock 114 coupled to first rail member 110 and configured to mate with first lock retainer 90 in lock hub 81 as suggested in FIGS. 9 and 10. In the illustrated embodiment, first rail lock 114 is defined by a pin that extends through two apertures formed in first rail member 110 as suggested in FIG. 9. First rail lock 114 is arranged to lie in spaced-apart relation to an inner end 116 of first rail member 110. First floor support rail 36 also includes a first rail pivot post 118 coupled to first rail member 110 and arranged to lie in a position between first rail lock 114 and inner end 116 of first rail member 110. First pivot axis 101 is established by first rail pivot post 118 as suggested in FIGS. 11 and 12. In the illustrated embodiment, first rail pivot post 118 is defined by a pin that extends through two apertures formed in first rail member 110 as suggested in FIG. 9.

Second floor support rail 40 includes a second rail member 120 extending into a second rail-receiving channel 122 formed in lock hub 81 and a second rail lock 124 coupled to second rail member 120 and configured to mate with second lock retainer 92 in lock hub 81 as suggested in FIGS. 9 and 10. In the illustrated embodiment, second rail lock 124 is defined by a pin that extends through two apertures formed in second rail member 120 as suggested in FIG. 9. Second rail lock 124 is arranged to lie in spaced-apart relation to an inner end 126 of second rail member 120. Second floor support rail 40 also includes a second rail pivot post 128 coupled to second rail member 120 and arranged to lie in a position between second rail lock 124 and inner end 126 of second rail member 120. Second pivot axis 102 is established by second rail pivot post 128 as suggested in FIGS. 11 and 12. In the illustrated embodiment, second rail pivot post 128 is defined by a pin that extends through two apertures formed in second rail member 120 as suggested in FIG. 9.

Lock hub 81 includes a pair of spaced-apart parallel side walls 130, 132, a mounting flange 134 appended to each of side walls 130, 132, a left top wall 136, and a right top wall 138 as shown, for example, in FIG. 9. Each side wall 130, 132 includes a first side wall portion 140 configured to define first lock retainer 90, a second side wall portion 142 configured to define second lock retainer 92, and a third side wall portion 144 arranged to interconnect first and second side wall portions 140, 142 and formed to define lock controller mount 94. Left top wall 136 and first side wall portions 140 of side walls 130, 132 cooperate to define first rail-receiving channel 112. Right top wall 138 and second side wall potions 142 of side walls 130, 132 cooperate to define second rail-receiving channel 122.

In the illustrated embodiment, first side wall portion 140 of each of side walls 130, 132 includes an edge 141 as shown in FIGS. 9 and 10. First lock retainer notches 146 are formed in first side wall portions 140 to have a rail lock-receiving opening formed in edge 141 to define first lock retainer 90. Likewise, second side wall portion 140 of each of side walls 130, 132 includes an edge 143 as shown in FIGS. 9 and 10. Second lock retainer notches 148 are formed in second side wall portions 142 to have a rail lock-receiving opening formed in edge 143 to define second lock retainer 92.

Figure 11:
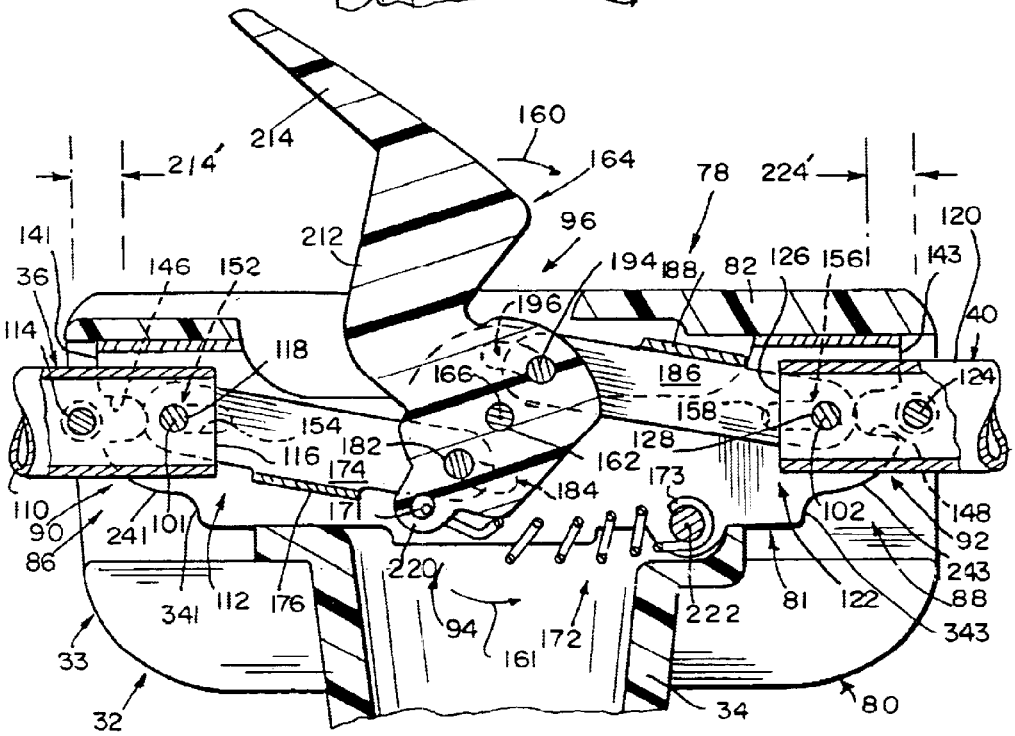
FIG. 11 is a sectional view similar to FIG. 10 showing clockwise pivoting movement of a lever mounted for pivotable movement on the lock hub against a biasing force provided by a spring coupled to the lever and to the lock hub to cause the two floor support rail members carrying the rail locks to move away from one another to move the rail locks out of the lock retainer notches formed in the lock hub so that the playyard floor support frame is "unlocked"

As suggested in FIGS. 10 and 11, first pivot post 118 is configured to move in a first post retainer 152 formed in lock hub 81 of rail mount 32. In the illustrated embodiment, each first side wall portion 140 of side walls 130, 132 is formed to include an oblong pivot post slot 154 defining first post retainer 152. Likewise, second pivot post 128 is configured to move in a second post retainer 156 formed in lock hub 81 of rail mount 32. In the illustrated embodiment, each second side wall portion 142 of side walls 130, 132 is formed to include an oblong pivot post slot 158 defining second post retainer 156.

Lock controller 96 is coupled to first floor support rail 36 and mounted on rail mount 32 for movement in a generally clockwise first direction 160 to move first rail pivot post 118 to an inner position in first pivot post slot 154 and to move second rail pivot post 128 to an inner position in second pivot post slot 158 as shown in FIG. 10. At the same time, first rail lock 114 is moved to engage first lock retainer 90 (by entering first lock retainer notch 146) and second rail lock 124 is moved to engage second lock retainer 92 (by entering second lock retainer notch 148). This happens upon movement of first and second floor support rails 36, 40 to the erected configuration to block pivoting movement of first floor support rail 36 about first rail pivot axis 101 and to block pivoting movement of second floor support rail 40 about second rail pivot axis 102.

Figure 12:
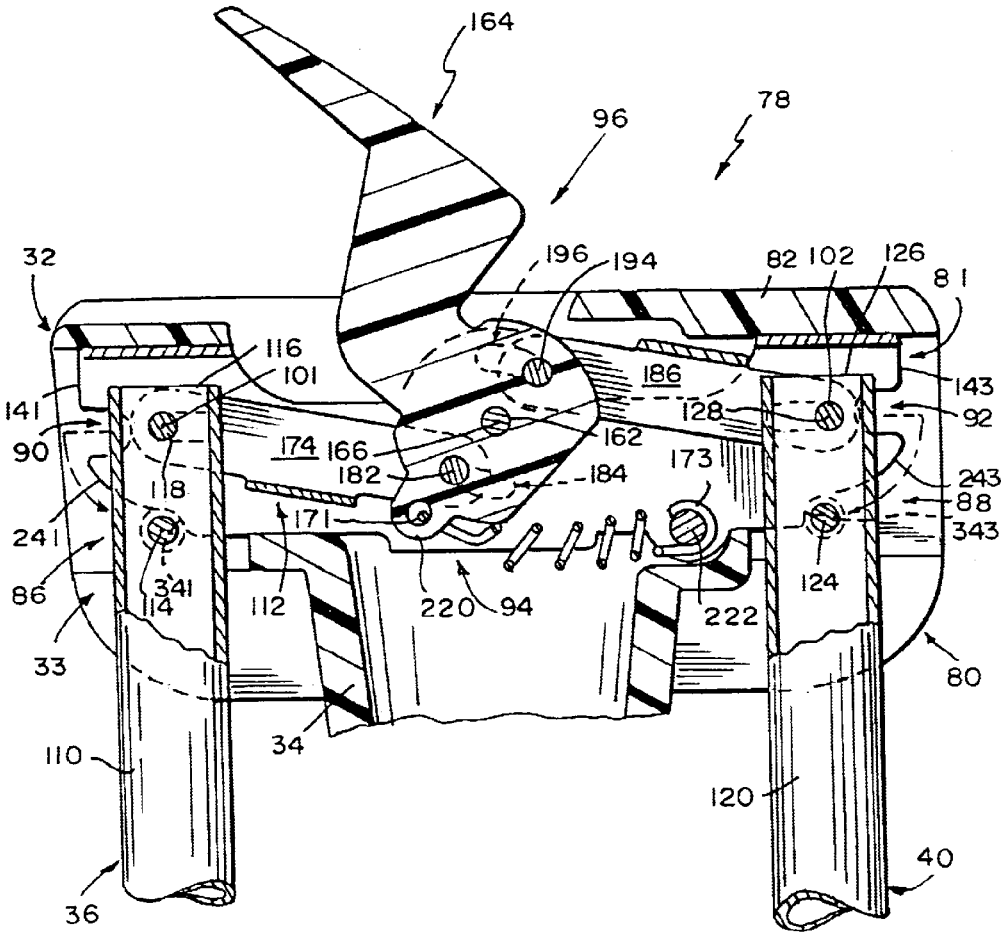
FIG. 12 is a sectional view similar to FIGS. 10 and 11 showing pivoting movement of the two floor support rails shown in FIG. 11 relative to the lock hub to a collapsed position (as shown in FIGS. 6–8) following movement of the rail locks on the floor support rails out of the lock retainer notches formed in the lock hub.

Lock controller 96 is also mounted on rail mount 32 for movement in a generally counterclockwise direction 161 to move first rail pivot post 118 to an outer position in first pivot post slot 154 and to move second rail pivot post 128 to an outer position in second pivot post slot 158 as shown in FIG. 11. At the same time, first rail lock 114 is moved to disengage first lock retainer 90 (by exiting first lock retainer notch 146) and second rail lock 124 is moved to disengage second lock retainer 92 (by exiting second lock retainer notch 148). Now, as shown in FIG. 12, first floor support rail 36 can be pivoted about first rail pivot axis 101 and second floor support rail 40 can be pivoted about second rail pivot axis 102 to allow movement of all support rails 36, 38, 40, 42 relative to rail mount 32 to assume the collapsed configuration.

As shown in FIGS. 9 and 10, lock controller 96 includes a lever pivot rod 162 coupled to lock controller mount 94 of lock hub 81 and a lever 164 mounted on lever pivot rod 162 for pivotable movement relative to lock hub 81 about a pivot axis 166 established by lever pivot rod 162. Lock controller 96 also includes mover means for moving first rail pivot post 118 in first pivot post slot 154 and second rail pivot post 128 in second pivot post slot 158 in response to movement of lever 164 (in direction 160 and 161) about pivot axis 166 to cause first and second floor support rails 36, 40 to move relative to lock hub 81. The mover means includes first and second rail movers 168, 170 and a driver spring 172 as shown, for example, in FIGS. 9 and 10.

As shown best in FIG. 9, first rail mover 168 includes a pair of legs 174 arranged to lie in spaced-apart parallel relation to one another and a bridge 176 interconnecting the legs 174. Each leg 174 includes an outer end formed to include an aperture 178 receiving a portion of first rail pivot post 118 therein and an inner end formed to include an aperture 180 receiving a portion of a first guide pin 182 therein. First guide pin 182 is arranged to move back and forth in a first arcuate guide pin slot 184 formed in lock controller mount 94 as suggested in FIGS. 10 and 11.

Second rail mover 170 includes a pair of legs 186 arranged to lie in spaced-apart relation to one another and a bridge 188 interconnecting the legs 186 as shown in FIG. 9. Each leg 186 includes an outer end formed to include an aperture 190 receiving a portion of second rail pivot post 128 therein and an inner end formed to include an aperture 192 receiving a portion of a second guide pin 194 therein. Second guide pin 194 is arranged to move back and forth in a second arcuate guide pin slot 196 formed in lock controller mount 94 as suggested in FIGS. 10 and 11.

Lever 164 includes a mover driver 210 formed to include a pivot post receiver 212 to receive lever pivot rod 162 therein. Lever 164 also includes a lever handle 214 coupled to mover driver 210 as shown in FIGS. 9 and 10. Lever 164 extends through a lever handle aperture 165 formed in cover plate 82. First guide pin 182 also extends through first apertures 216 formed in mover driver 210 and second guide pin 194 also extends through second apertures 218 formed in mover driver 210. Pivot post receiver 212 is positioned to lie between first and second apertures 216, 218 as suggested in FIG. 9.

A coiled compression driver spring 172 has one end 171 coupled to spring mount receiver 220 formed in mover driver 210 and another end 173 coupled to a spring mount 222 extending through spring mount receivers 224 formed in side walls 130, 132 of lock hub 81 as suggested in FIGS. 9 and 10. Driver spring 172 is coupled to lock hub 81 and to lever 164 to apply a biasing force to lever 164 to move lever 164 relative to lock hub 81 to cause first rail mover 168 to move first rail pivot post 118 normally to the inner position in first pivot post slot 154 and to cause second rail mover 170 to move second rail pivot post 128 normally to the inner position in second pivot post slot 158 as shown in FIG. 10. Thus, lock controller 96 includes retainer means for yieldably urging first and second rail pivot posts 118, 128 to their inner positions in slots 154, 158 so that first rail lock 114 is moved into first lock retainer notch 146 and second rail lock 124 is moved into second lock retainer notch 148 upon movement of floor support rails 36, 38, 40, 42 to the erected configuration shown in FIG. 1.

Driver spring 172 is extensible as shown in FIG. 11 so that it does not operate to block withdrawal of rail locks 114, 124 from lock retainer notches 146, 148 during movement of floor support rails 36, 38, 40, 42 from the erected configuration shown in FIG. 1 to the collapsed configuration shown in FIGS. 6–8 and 12. Driver spring 72 operates to yieldably pivot lever 164 relative to rail mount 132 about pivot axis 166 to cause movement of each rail mover 168, 170 relative to rail mount 32 so that each rail lock 114, 124 is drawn into and retained in its companion lock retainer notch 146, 148 in response to movement of floor support rails 36, 38, 40, 42 from the collapsed configuration toward the erected configuration to place each rail lock 168, 170 in confronting relation to a mouth formed in rail mount 32 to provide an opening into the companion lock retainer notch 146, 148.

In operation, as suggested in FIGS. 10–12, lever 164 can be pivoted in counterclockwise direction 161 to move first and second rail members 110, 120 toward one another in first and second rail-receiving channels 112, 122 formed in lock hub 81 to cause first and second pivot posts 118, 128 to move toward one another in first and second pivot post slots 154, 158 and move first and second rail locks 114, 124 into companion rail lock retainer notches 146, 148. Lever 164 can also be pivoted in clockwise direction 160 to move first and second rail members 110, 120 away from one another in first and second rail-receiving channels 112, 122 to cause first and second rail pivot posts 118, 128 to move away from one another in first and second pivot post slots 154, 158. This also causes first rail lock 114 to move a distance 214 (see FIG. 11) to disengage first rail lock retainer notch 146 allowing pivotable movement of first rail member 110 (as shown in FIG. 12) about first rail pivot post 118 (and pivot axis 101) and causes second rail lock 124 to move a distance 224 (see FIG. 11) to disengage second rail lock retainer notch 148 allowing pivotable movement of second rail member 120 (as shown in FIG. 12) about second rail pivot post 128 (and pivot axis 102).

Pivoting movement of first and second rail members 110, 120 from a horizontal position to a vertical position is shown in FIGS. 11 and 12. During such movement, first ail lock 114 included in first floor support rail 36 moves through a 90° angle along an arc defined by a lower portion 241 of edge 141 to reach a stop wall 341 to block further counterclockwise pivoting movement of first rail member 110. At the same time, second rail lock 114 included in second floor support rail 40 moves through a 90° angle along an arc defined by a lower portion 243 of edge 241 to reach a stop wall 343 to block further clockwise pivoting movement of second rail member 120. This position corresponds to the collapsed configuration of playyard 10 shown in FIGS. 6–8.

What is claimed is:

1. A playyard floor support frame comprising a rail mount formed to include a post retainer and a lock retainer, a first floor support rail including a rail pivot post arranged to extend into the post retainer formed in the rail mount to support the first floor support rail for pivotable movement about a rail pivot axis established by the rail pivot post between an erected configuration adapted to support a floor mat on the first floor support rail and above the rail mount and a collapsed configuration adapted to facilitate storage of the playyard floor support frame, the first floor support rail also including a rail lock arranged to engage the lock retainer formed in the rail mount upon movement of the first floor support rail to the erected configuration and to disengage the lock retainer upon movement of the first floor support rail to the collapsed configuration, and a lock controller coupled to the first floor support rail and mounted on the rail mount for movement in a first direction to move the rail pivot post to an inner position in the post retainer and to move the rail lock to engage the lock retainer upon movement of the first floor support rail to the erected configuration to block pivoting movement of the first floor support rail about the rail pivot axis and in a second direction to move the rail pivot post to an outer position in the post retainer and to move the rail lock to disengage the lock retainer to allow pivoting movement of the first floor support rail about the rail pivot axis to allow movement of the first floor support rail relative to the rail mount to assume the collapsed configuration.

2. The frame of claim 1, wherein the rail mount includes a lock hub formed to include a pivot post slot defining the post retainer and the rail pivot post is arranged to move back and forth in the pivot post slot in response to movement of the first floor support rail between the erected and collapsed configurations.

3. The frame of claim 2, wherein the lock controller includes a lever pivot rod coupled to the lock hub, a lever mounted on the lever pivot rod for pivotable movement relative to the lock hub about a pivot axis established by the lever pivot rod, and mover means for moving the rail pivot post in the pivot post slot in response to movement of the lever about the pivot axis to cause the first floor support rail to move relative to the lock hub.

4. The frame of claim 3, wherein the lock hub further includes a lock retainer notch defining the lock retainer, the rail lock is arranged to lie in the lock retainer notch upon movement of the first floor support rail to the erected configuration and to lie outside the lock retainer notch upon movement of the first floor support rail to the collapsed configuration, and the rail pivot post is arranged to lie in a position between the lever pivot rod and the rail lock upon movement of the first floor support rail to the erected configuration.

5. The frame of claim 3, wherein the lock hub is formed to include a guide pin slot and the mover means includes a guide pin arranged to move back and forth in the guide pin slot and a rail mover having an outer end coupled to the rail pivot post and an inner end coupled to the guide pin.

6. The frame of claim 2, wherein the lock controller includes retainer means for yieldably urging the rail pivot post to the inner position in the post retainer so that the rail lock is moved to engage the lock retainer upon movement of the first floor support rail to the erected configuration.

7. The frame of claim 6, wherein the retainer means includes a lever mounted for movement on the lock hub, a rail mover coupled to the lever and to the rail pivot post, and a spring coupled to the lock hub and to the lever to apply a biasing force to the lever to move the lever relative to the lock hub to cause the rail mover to move the rail pivot post normally to the inner position in the post retainer.

8. The frame of claim 1, wherein the rail mount further includes a lock retainer notch defining the lock retainer, the rail lock is arranged to lie in the lock retainer notch upon movement of the first floor support rail to the erected configuration and to lie outside the lock retainer notch upon movement of the first floor support rail to the collapsed configuration, and the lock controller includes retainer means for yieldably retaining the rail lock in the lock retainer notch upon movement of the first floor support rail to the erected configuration without blocking withdrawal of the rail lock from the lock retainer notch formed in the rail mount during movement of the first floor support rail from the erected configuration to the collapsed configuration.

9. The frame of claim 8, wherein the retainer means includes a lever mounted for pivotable movement on the rail mount about a pivot axis, a rail mover coupled to the lever and to the rail pivot post, and spring means for yieldably pivoting the lever relative to the rail mount about the pivot axis to cause movement of the rail mover relative to the rail mount so that the rail lock is drawn into and retained in the lock retainer notch in response to movement of the first floor support rail from the collapsed configuration toward the erected configuration to place the rail lock in confronting relation to a mouth formed in the rail mount to provide an opening into the lock retainer notch.

10. The frame of claim 9, wherein the rail mount includes a lock hub formed to include the post retainer and the lock retainer notch and a base, the base includes a hub receiver formed to include a chamber receiving the lock hub therein and a foot coupled to the hub receiver to elevate the hub receiver above ground underlying the hub receiver, and further comprising additional floor support rails mounted for pivotable movement on the hub receiver between an erected configuration adapted to support a floor mat supported on the first floor support rail and a collapsed configuration adapted to facilitate storage of the playyard floor support frame.

11. The frame of claim 1, wherein the first floor support rail includes a rail member, the rail lock is coupled to the rail member to lie in spaced-apart relation to an inner end of the rail member, and the rail pivot post is coupled to the rail member and arranged to lie in a position between the rail lock and the inner end of the rail member.

12. The frame of claim 11, wherein the rail mount is formed to include a rail-receiving channel and the inner end of the first floor support rail is positioned to remain in the rail-receiving channel upon movement of the first floor support rail between the erected position and the collapsed configuration.

13. The frame of claim 12, wherein the rail mount includes a side wall arranged to define a boundary of the rail-receiving channel, the side wall is formed to include an oblong pivot post slot defining the post retainer and receiving the rail pivot post for back-and-forth movement therein and a lock retainer notch having a rail lock-receiving opening formed in an edge of the side wall and receiving the rail lock upon movement of the first floor support rail to the erected configuration.

14. A playyard floor support frame comprising a rail mount including a lock hub formed to include first and second rail-receiving channels and a lock controller mount located between the first and second rail-receiving channels, a first floor support rail including a first rail member extending into the first rail-receiving channel, a first rail lock coupled to the first rail member and arranged to lie in spaced-apart relation to an inner end of the first rail member, and a first rail pivot post coupled to the first rail member and arranged to lie in a position between the first rail lock and the inner end of the first rail member, the first rail pivot post extending into a first pivot post slot formed in the lock hub for back-and-forth movement therein, a second floor support rail including a second rail member extending into the second rail-receiving channel, a second rail lock coupled to the second rail member and arranged to lie in spaced-apart relation to an inner end of the second rail member, and a second rail pivot post coupled to the second rail member and arranged to lie in a position between the second rail lock and the inner end of the second rail member, the second rail pivot post extending into a second pivot post slot formed in the lock hub for back-and-forth movement therein, and a lock controller coupled to the first and second floor support rails and mounted on the lock controller mount for movement in a first direction to move the first and second rail members toward one another in the first and second rail-receiving channels to cause the first and second rail pivot posts to move toward one another in the first and second pivot post slots and for movement in an opposite second direction to move the first and second rail members away from one another in the first and second rail-receiving channels to cause the first and second rail pivot posts to move away from one another in the first and second pivot post slots and to cause the first rail lock to disengage a first lock retainer formed in the rail mount allowing pivotable movement of the first rail member about the first rail pivot post and relative to the rail mount and to cause the second rail lock to disengage a second lock retainer formed in the rail mount allowing pivotable movement of the second rail member about the second rail pivot post relative to the rail mount.

15. The frame of claim 14, wherein the rail mount further includes a base including a hub receiver formed to include a chamber receiving the lock hub therein and a foot coupled to the hub receiver to elevate the hub receiver above ground underlying the hub receiver.

16. The frame of claim 15, wherein the foot is positioned to lie underneath the lever mount of the lock hub.

17. The frame of claim 15, further comprising additional floor support rails mounted for pivotable movement on the hub receiver between an erected configuration adapted to support a floor mat supported on the first and second floor support rails above the rail mount upon movement of the first rail locks to engage the first lock retainer and the second rail lock to engage the second lock retainer.

18. The frame of claim 14, wherein the lock hub includes a first side wall portion arranged to define a boundary of the first rail-receiving channel and formed to include a first lock retainer notch having a rail lock-receiving opening formed in an edge of the first side wall and defining the first lock retainer and the lock hub further includes a second side wall portion arranged to define a boundary of the second rail-receiving channel and formed to include a second lock retainer notch having a rail lock-receiving opening formed in an edge of the second side wall and defining the second lock retainer.

19. The frame of claim 18, wherein the lock hub further includes a third side wall portion arranged to interconnect the first and second side wall portions and formed to define the lock controller mount.

20. The frame of claim 18, wherein the first and second pivot post slots are located between the first and second lock retainer notches.

21. The frame of claim 14, wherein the lock controller includes a lever pivot rod coupled to the lock controller mount, a lever mounted on the lever pivot rod for pivotable movement relative to the lock hub about a pivot axis established by the lever pivot rod in the first and second directions, a first rail mover coupled to the lever and to the first floor support rail and arranged to move the first floor support rail away from the second support rail in response to pivotable movement of the lever in the second direction, and a second rail mover coupled to the lever and to the second floor support rail and arranged to move the second floor support rail away from the first support rail in response to pivotable movement of the lever in the second direction.

22. The frame of claim 21, wherein the lock controller further includes spring means for yieldably urging the lever to pivot in the first direction to cause the first and second rail movers to move the first and second support rails toward one another.

23. A playyard floor support frame comprising four corner feet, a rail mount, four floor support rails, each floor support rail including an outer end pivotably coupled to one of the corner feet and an inner end associated with the rail mount to enable collapsing movement of the floor support rails between an erected configuration wherein the floor support rails are arranged to lie in an X-shaped pattern and adapted to support a floor mat thereon and above the rail mount and a collapsed configuration wherein the floor support rails are arranged to lie in mutually parallel relation to facilitate storage of the floor support frame, a first of the floor support rails including a first rail member and a first rail lock coupled to the first rail member and arranged to lie in spaced-apart relation to an inner end of the first rail member, the first rail lock being configured to mate with the rail mount to block movement of the first of the floor support rails from the erected configuration to the collapsed configuration and separate from the rail mount to allow movement of the first of the floor support rails from the erected configuration to the collapsed configuration, and a lock controller coupled to the first of the floor support rails and mounted on the rail mount for movement in a first direction to move the first rail lock to mate with the rail mount and for movement in an opposite second direction to move the first rail lock to separate from the rail mount.

24. A playyard floor support frame comprising a lock hub arranged to lie under a playyard floor, first and second floor support rails mounted for movement in rail-receiving channels formed in the lock hub, a base configured to receive and elevate the lock hub above ground underlying the base, and a lock controller mounted on the lock hub and coupled to the first and second floor support rails for movement in a first direction to move the first and second floor support rails in the rail-receiving channels toward one another to lock the first and second floor support rails to the lock hub and for movement in a second direction to move the first and second floor support rails in the rail-receiving channels away from one another to unlock the first and second floor support rails from the lock hub.

* * * * *